US009957085B2

(12) United States Patent
Bourdin et al.

(10) Patent No.: US 9,957,085 B2
(45) Date of Patent: May 1, 2018

(54) CARDBOARD BOX HAVING A CENTRING TAB, BLANK, SET OF BLANKS AND METHOD FOR PRODUCING SUCH A BOX

(71) Applicant: Otor, Puteaux (FR)

(72) Inventors: Olivier Bourdin, Le Quesnel (FR); Arnaud Guerin, Rostrenen (FR); Nicolas Le Lay, Clichy (FR)

(73) Assignee: OTOR, Puteaux (FR)

( * ) Notice: Subject to any disclaimer, the term of this patent is extended or adjusted under 35 U.S.C. 154(b) by 0 days. days.

(21) Appl. No.: 14/646,414

(22) PCT Filed: Nov. 21, 2013

(86) PCT No.: PCT/FR2013/052822
§ 371 (c)(1),
(2) Date: May 21, 2015

(87) PCT Pub. No.: WO2014/080135
PCT Pub. Date: May 30, 2014

(65) Prior Publication Data

US 2015/0291307 A1 Oct. 15, 2015

(30) Foreign Application Priority Data

Nov. 21, 2012 (FR) ..... 12 61059

(51) Int. Cl.
*B65D 5/00* (2006.01)
*B65D 21/02* (2006.01)
(Continued)

(52) U.S. Cl.
CPC ..... *B65D 21/0212* (2013.01); *B31B 50/26* (2017.08); *B65D 5/001* (2013.01);
(Continued)

(58) Field of Classification Search
CPC .... B65D 21/0121; B65D 5/001; B65D 5/003; B65D 5/0035
(Continued)

(56) References Cited

U.S. PATENT DOCUMENTS 3,253,768 A 5/1966 Gjesdal
4,373,659 A 2/1983 Cornell et al.
(Continued)

FOREIGN PATENT DOCUMENTS

DE 29902192 U1 4/1999
DE 19919589 A1 11/2000
(Continued)

OTHER PUBLICATIONS

English Machine Translation for DE 20 2008 014 520 U1.*
International Search Report of PCT/FR2013/052822, dated Mar. 13, 2014.

*Primary Examiner* — Christopher Demeree
*Assistant Examiner* — Phillip Schmidt
(74) *Attorney, Agent, or Firm* — Banner & Witcoff, Ltd.

(57) ABSTRACT

The present invention relates to a box, a blank, a set of blanks made from corrugated cardboard sheet and a method for forming a box having a polygonal section. The box has at least one centring tab (7) straddling at least one folding line (4) on its upper wall (2), cut out on its lateral sides (8), connected on one side to the upper wall (2) by a first joining line (10) and on the other side to the adjacent side wall (5) by a second joining line (6), a parallel and offset intermediate folding line (14) being provided such that the tab (7) forms a projecting portion (16) on account of the folding. The bottom comprises at least one perforated surface portion (18) which has a shape complementary to that of the tab such that the lateral edges of the recess are designed to cooperate
(Continued)

in contact with the lateral edges of said tab, and is designed to fit into the projecting portion of a box from below.

33 Claims, 8 Drawing Sheets

(51) Int. Cl.
*B65D 5/12* (2006.01)
*B31B 50/26* (2017.01)
*B65D 5/02* (2006.01)
*B65D 5/20* (2006.01)

(52) U.S. Cl.
CPC ..... *B65D 5/003* (2013.01); *B65D 5/0227* (2013.01); *B65D 5/12* (2013.01); *B65D 5/02* (2013.01); *B65D 5/20* (2013.01)

(58) Field of Classification Search
USPC ..... 229/930, 931, 917, 109
See application file for complete search history.

(56) References Cited

U.S. PATENT DOCUMENTS

| | | | | |
|---|---|---|---|---|
| 8,931,686 | B2 * | 1/2015 | Brundage | B65D 5/001 229/109 |
| 9,475,603 | B2 * | 10/2016 | Jacomelli | B65D 5/001 |
| 2012/0273383 | A1 * | 11/2012 | Bahr | B65D 71/0007 206/561 |

FOREIGN PATENT DOCUMENTS

| | | | |
|---|---|---|---|
| DE | 202008014520 | U1 | 1/2009 |
| DE | 202008010831 | U1 | 12/2009 |
| EP | 0468860 | A1 | 1/1992 |
| FR | 2761341 | A1 | 10/1998 |
| GB | 2065074 | A | 6/1981 |
| GB | 2247876 | A | 3/1992 |

* cited by examiner

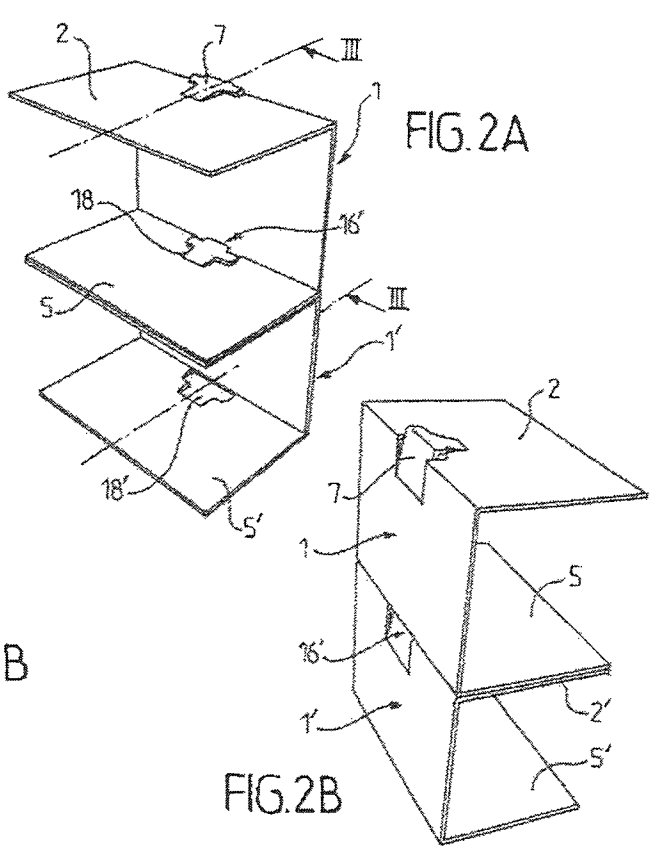
FIG.2A
FIG.2B
III
III
1
1'
2
2'
5
5'
7
16'
18
18'
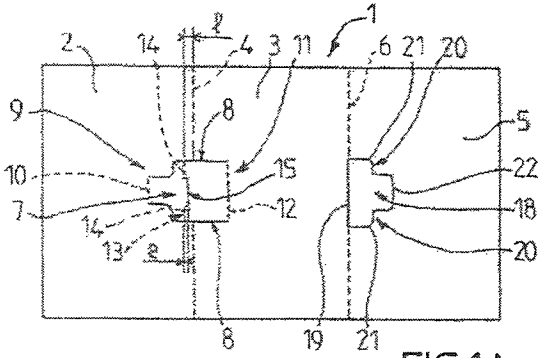
FIG.1A
1
2
3
4
5
6
7
8
9
10
11
12
13
14
15
18
19
20
21
22
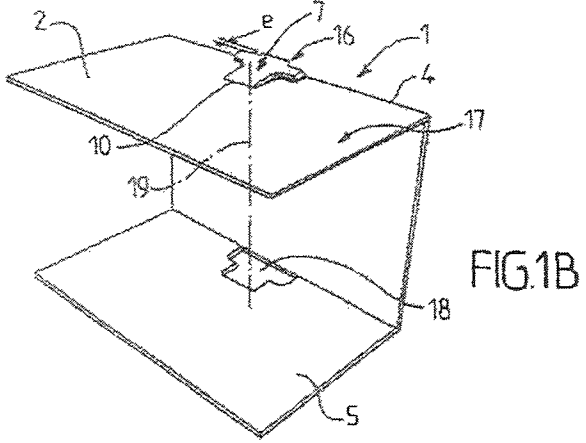
FIG.1B
1
2
4
5
7
10
16
17
18
19

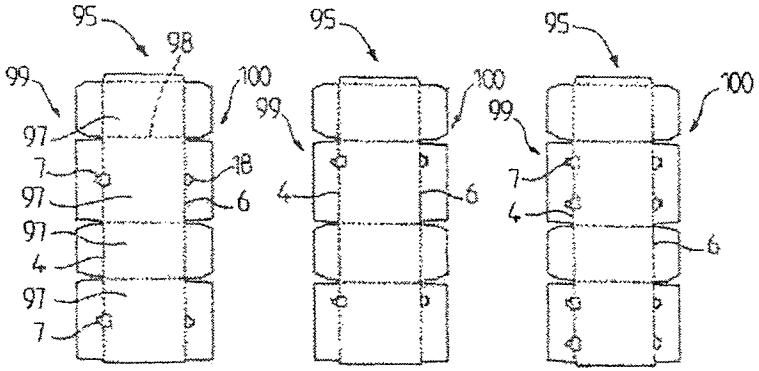
FIG.8A
FIG.8B
FIG.8C
FIG.8D
FIG.8E
FIG.8F
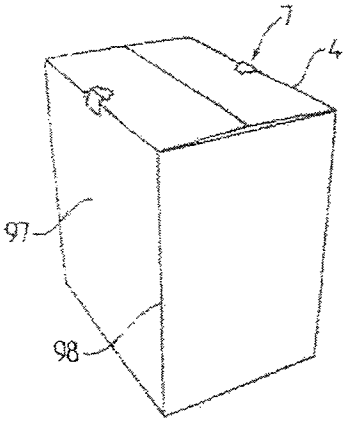
FIG.8

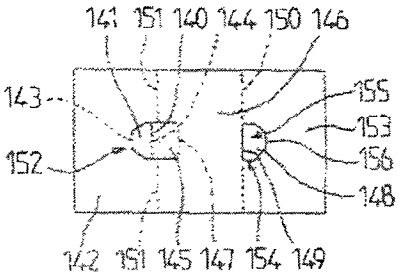
FIG.12A
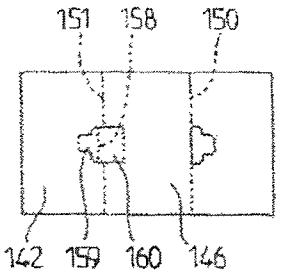
FIG.12B
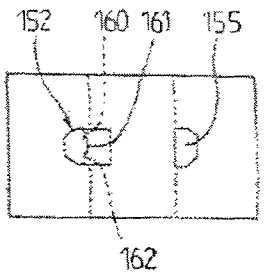
FIG.12C
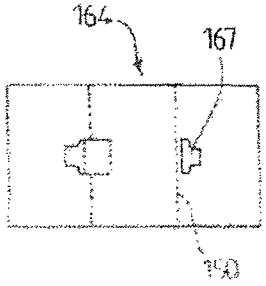
FIG.13A
FIG.13B
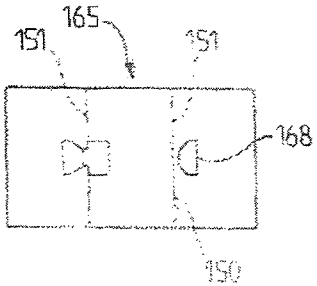
FIG.13C

CARDBOARD BOX HAVING A CENTRING TAB, BLANK, SET OF BLANKS AND METHOD FOR PRODUCING SUCH A BOX

The present invention relates to a box made of corrugated cardboard sheet having a polygonal section comprising lateral walls, an upper wall that forms the top of the box and that is connected to at least one of the lateral walls by first fold lines and a lower wall forming the bottom of the box.

It also relates to blanks and a method for forming such a box.

It is particularly, although not exclusively, usable in the domain of boxes that can be stacked on pallets, said boxes having a tendency to slide in relation to one another when they are handled during different phases of transportation.

Systems for centering boxes that prevent same from sliding by using lateral tenons cooperating with orifices positioned on or near the edges are already known.

Such systems are fragile and cannot withstand repeated handling.

Packaging in which the cover is formed of flaps some of which have a shape matching the shape of notches formed in the bottom, which is also made of flaps, enabling engagement and therefore lateral locking, is also known (FR 2 311 717).

Apart from the fact that this embodiment requires flaps and overlaps on the surfaces of the upper and lower walls, it does not help to reduce weight and does not enable perfectly vertical stacking on account of the offsetting that may occur when forming the packaging.

Boxes having folding locking elements forming a tip unfolded outwards when installed and arranged to cooperate with a corresponding notch in the bottom of the box above are also known (DE 20 2008 014).

Although such elements enable engagement, they are inefficient in preventing sliding caused by the play between the tip and the notch, which is caused by the structural arrangement of same.

The present invention is intended to provide a box made of corrugated cardboard sheet that satisfies practical requirements better than known boxes, in particular because firstly it provides real centering of the boxes on one another enabling lateral placement before interlocking and excellent locking without the risk of damaging the centering means that are used, and secondly it enables a simple, cheap, automatic box formation without bonding of the centering means, and finally in that it prevents lateral sliding in the transverse and/or longitudinal directions between boxes superposed on one another more efficiently than before.

The invention therefore prevents the boxes from sliding when they are stacked onto one another on pallets, thereby enabling the use of lighter weights and obviating the need for costly palletization accessories that generate additional handling work.

It will also be possible to cause automatic centering when forming and/or closing the box, which in particular prevents all risk of damage to the box during prior transportation of the blanks used to make the boxes.

For this purpose, the present invention in particular proposes a box made of corrugated cardboard sheet having a polygonal section comprising lateral walls, an upper wall forming the top of the box and connected to at least two of the lateral walls by first fold lines and a lower wall forming the bottom of the box, said box comprising at least one tab straddling at least one of said first fold lines on the lateral sides crossing said one of said first fold lines or first fold line, connected on one side to the upper wall by a first join line and on the other side to the adjacent lateral wall by a second join line, said join lines being parallel to said first fold line, said tab also having an intermediate parallel fold line offset towards the center of the box in relation to said first fold line, such that the tab forms a portion projecting from the upper face of the upper wall on account of the folding of the lateral wall in relation to the upper wall, and the bottom having at least one perforated surface portion arranged to cooperate with said projecting portion, to be aligned with this latter and to engage with the projecting portion of a box below, characterized in that the tab is a centering tab and the perforated surface portion is a recess matching the shape of said tab, the edges of the recess being arranged to cooperate in contact with the lateral peripheral edges of said tab.

Cooperate in contact means coming into contact with one another at at least one point or on a given surface, along the length and/or thickness of the cardboard about that point.

With such an arrangement, the lateral peripheral edges of the recess and the lateral peripheral edges of the tab are vertically aligned or substantially vertically aligned with one another, with no offsetting or with a slight offset of no more than 1 mm, thereby enabling perfect locking, there being no or substantially no recess following engagement between these elements.

Perforated surface portion or recess of matching shape therefore means a flat recess dimensioned such that the projecting portion or part inserted therein butts against at least one portion of the periphery of the recess, which prevents the longitudinal and transverse movements of one box in relation to another in the horizontal plane.

The invention ensures that there is no or practically no play on each side of the lateral periphery of the tabs, which enables a tight fit.

In other words, the tab locks on the material of the cardboard of the lower face of the box above, like in a puzzle, which does not result in stacking (as in the prior art) but rather enables genuine centering.

The invention is therefore notably based in part on the idea of creating the projecting portion when folding the upper face of the box about the first corresponding fold line, which requires a clean, precise, non-destructive fold of the projection during formation and/or ejection of the box from the related forming means, while providing a close fit for the tab in the recess.

Offset means a join line parallel to and situated at a distance l from the first fold line.

In advantageous embodiments, either or both of the following arrangements may be used:

- the lateral peripheral edges of the tab have a cavity arranged to cooperate in contact with a matching cavity in the recess of the carton below.

This cavity advantageously enables a stop at a point C or on the thickness of the cardboard about a point C, on a tab edge portion parallel or substantially parallel to the first fold line;

- the intermediate fold line has two lateral portions aligned at a distance l from the first fold line on either side of a central cutout portion located at a distance l-e from said fold line.

Such an arrangement provides much more efficient lateral locking, surprisingly so in the longitudinal direction of the carton, the structure of the edge of the protuberance formed by the central portion enabling it to butt or substantially butt against the internal wall of the carton above via the recess in the bottom of this latter.

Advantageously, e is between ⅓ and ¾ of the thickness of the corrugated cardboard, for example half of said thickness;

the distance e is between 1 mm and 3 mm;

given that points A, B, C and D are defined as follows:

Point A: central point of the cutout portion.

Point B: central point of the lateral aligned portion of the intermediate join line.

Point C: central midpoint of the shoulder of the tab portion located on the side of the upper wall.

Point D: central point of the first join line of the tab;

The four points A, B, C and D in the lateral plane are aligned on a straight line (for example according to the equation y=a'x+b'), point C being positioned in the thickness of the cardboard of the bottom wall of the carton above;

the intermediate fold line is at a distance l of between 1 mm and 5 mm from said first fold line;

the lower wall and the lateral walls are formed by a tray and the upper wall by two facing ledges linked to the adjacent lateral walls by first fold lines;

the lower wall and the lower portion of the lateral walls are formed by a tray, and the upper portion of the lateral walls is formed by a succession of at least four adjacent shutters linked together by second fold lines, the upper wall being formed by the flaps linked to the adjacent shutters by said first fold lines;

the box includes a tray having a central shutter forming the upper or lower wall, and flaps, and the lateral walls and the lower or upper wall are formed by a succession of three adjacent shutters linked together by third fold lines and including on either side a first set and a second set of flaps respectively linked to the adjacent shutters by fourth fold lines or said first fold lines, to form two facing lateral walls;

the box includes a tray having a central shutter forming the upper or lower wall, and flaps, and the lateral walls and the lower or upper wall are formed by a succession of three adjacent shutters linked together by fifth fold lines or two of said first fold lines and including on either side a first set and a second set of flaps respectively linked to the adjacent shutters by sixth fold lines or two first fold lines, to form two facing lateral walls;

the lateral walls are formed by a succession of at least four adjacent shutters linked together by seventh fold lines and include on either side a first set of flaps and a second set of flaps respectively linked to the adjacent shutters by said first fold lines or eighth fold lines to form respectively the upper and lower walls;

the recesses are formed by slots or by two slot portions on a corresponding lateral flap edge, and it includes a slot or two slot portions enabling the free passage of the tab on the adjacent flap edge located on the side of the tab.

Slot or slot portion enabling the free passage of the tab means a slot or two facing half-slots through which the tab can pass freely when in projecting position, while enabling the excellent centering sought;

the box comprises four main lateral walls separated by four intermediate walls with no flaps forming cutoff corners;

it includes at least two centering tabs and two corresponding recesses, for example four tabs and four recesses;

each tab and each corresponding recess is trapezoid-shaped;

each tab and each corresponding recess is T-shaped. T-shaped means a nonlimiting shape, for example a wide leg, for example one or more centimeters wide, for example connected on the side of the upper wall, by the first join line, to a wide cross bar that is for example wider than the leg connected to the lateral wall by the second join line.

the recess has a parallel edge and is located at a distance d' from the connection line of a lateral wall with the lower wall, facing and parallel to the first fold line;

d' is equal to 0;

d' is equal to d.

The invention also proposes a blank or a set of blanks enabling such a box to be obtained.

Notably, it also proposes a blank or set of blanks made of corrugated cardboard sheet intended to form a box having a polygonal section comprising lateral walls, an upper wall that is used to form the top of the box and that is connected to at least two of the lateral walls by first fold lines and a lower wall used to form the bottom of the box, said blank including at least one tab straddling at least one of said first fold lines, cut along the lateral sides of same crossing said first fold line and linked on one side to the upper wall by a first join line and on the other side to the adjacent lateral wall by a second join line, said join lines being parallel to said first fold line, said tab also having an intermediate parallel fold line offset towards the center of the box in relation to said first fold line, such that the tab forms a portion projecting from the upper face of the upper wall during folding of the lateral wall in relation to the upper wall, the bottom having at least one perforated surface portion arranged to cooperate with said projecting portion, and to be aligned with this latter when the box is formed and to engage with the projecting portion of a box below, characterized in that the tab is a centering tab and the perforated surface portion is a recess matching the shape of said tab, the edges of the recess of a box being arranged to cooperate in contact with the lateral peripheral edges of the tab of the box below.

Advantageously, the blank includes a central shutter that is used to form the bottom of a tray and that is linked to four paired opposing flaps used to form the lateral walls of said tray, two of said opposing flaps being linked on the other side of said central shutter to a second flap by said first fold lines to form two opposing ledges when the box is formed.

Also advantageously, the set of blanks includes a first blank used to form a tray to form the lower wall and the lower portion of the lateral walls, and it includes a second flap used to form the upper portion of the lateral walls, said second blank comprising a succession of at least four adjacent shutters linked together by second fold lines, the upper wall being formable using flaps linked to the adjacent shutters by said first fold lines.

In an advantageous embodiment, the set includes a first blank used to form a tray having a central shutter forming the upper or lower wall, and flaps, and a second blank used to form the lateral walls and the lower or upper wall, said second blank comprising a succession of three adjacent shutters linked together by third fold lines and including on either side a first set and a second set of flaps respectively linked to the adjacent shutters by fourth fold lines or said first fold lines, to form two facing lateral walls during formation of the box.

In another advantageous embodiment, the set includes a first blank used to form a tray having a central shutter forming the upper or lower wall, and flaps, and a second blank used to form the lateral walls and the lower or upper wall, said second blank comprising a succession of three adjacent shutters linked together by fifth fold lines or two of said first fold lines and including on either side a first set and a second set of flaps respectively linked to the adjacent shutters by sixth fold lines or two other first fold lines, to form two facing lateral walls during formation of the box.

Advantageously, the blank includes a succession of at least four adjacent shutters linked together by seventh fold lines to form lateral walls provided on either side of a first set of flaps and of a second set of flaps linked respectively to the adjacent shutters by said first fold lines or eighth fold lines to form respectively the upper and lower walls during formation of the box.

Also advantageously, the recesses are formed by slots or by two slot portions on a corresponding lateral flap edge, and it includes a slot or two slot portions enabling the free passage of the tab on the adjacent flap edge located on the side of the tab.

The slot portions are identical but symmetrical about the opposing end edge of same to form a single slot once the box has been formed.

In another advantageous embodiment, each blank is arranged to form four lateral walls or four main wall portions separated by four intermediate walls or wall portions with no flaps to form cutoff corners during formation of the box.

The invention also proposes a method and/or a device for forming a box as described above and/or using blanks such as those also described above.

It also proposes a method for forming a box made of corrugated cardboard sheet having a polygonal section comprising lateral walls, an upper wall forming the top of the box and connected to at least two of the lateral walls by first fold lines and a lower wall forming the bottom of the box, characterized in that, the box comprising at least one tab straddling at least one of said first fold lines, cut on the lateral sides of same crossing said one of said first fold lines or first fold line, connected on one side to the upper wall by a first join line and on the other side to the adjacent lateral wall by a second join line, said join lines being parallel to said first fold line, said tab also having an intermediate parallel fold line offset towards the center of the box in relation to said first fold line, and the bottom having at least one perforated surface portion matching the shape of said tab, the box is formed about a mandrel.

Advantageously, the box is formed by folding the lateral wall in relation to the upper wall about an edge of said mandrel including a receiving slot, such that the tab forms a portion projecting from the upper face of the upper wall on account of said folding and engages with the inside of said slot, and the mandrel is retractable into the volume of same or includes zones that are retractable downstream in the ejection direction of the projecting portion, the slotted edges are removed before ejection of the box.

Advantageously, at least two projecting portions on two opposing fold lines of the upper wall are formed.

The invention also proposes a device for forming a box about a mandrel characterized in that the mandrel includes at least one edge with a lateral slot for forming the projection and in that the edges of the mandrel are retractable between a first position for forming the projection about the edge in the slot and a second position for ejecting the box from said mandrel.

The invention is further explained in the description below of different embodiments given by way of nonlimiting examples.

The description relates to the attached drawings, in which:

FIGS. 1A and 1B show respectively a top view and an axionometric perspective view of a blank portion showing a first embodiment of the invention.

FIGS. 2A and 2B are front and rear perspective views of two blank portions from FIG. 1A stacked on one another and showing the engagement.

FIG. 8 is a perspective view of another embodiment of the box according to the invention.

FIG. 8A is a top view of the blank used to obtain the box in FIG. 8.

FIGS. 8B to 8F are top views of other embodiments of blanks according to the invention.

FIGS. 12A to 12C and 13A to 13C are top views of blank portions showing different shapes or embodiments of tabs and recesses that can be used in the boxes according to the invention.

In the remainder of the description, where possible, the same reference signs are used to identify the same or similar elements.

FIGS. 1A and 1B show a corrugated cardboard blank portion 1 that is for example lightweight, for example 2 mm thick, that can be used in a box made of corrugated cardboard sheet having a polygonal section.

Figures 3, 3A, 3B, 3C:
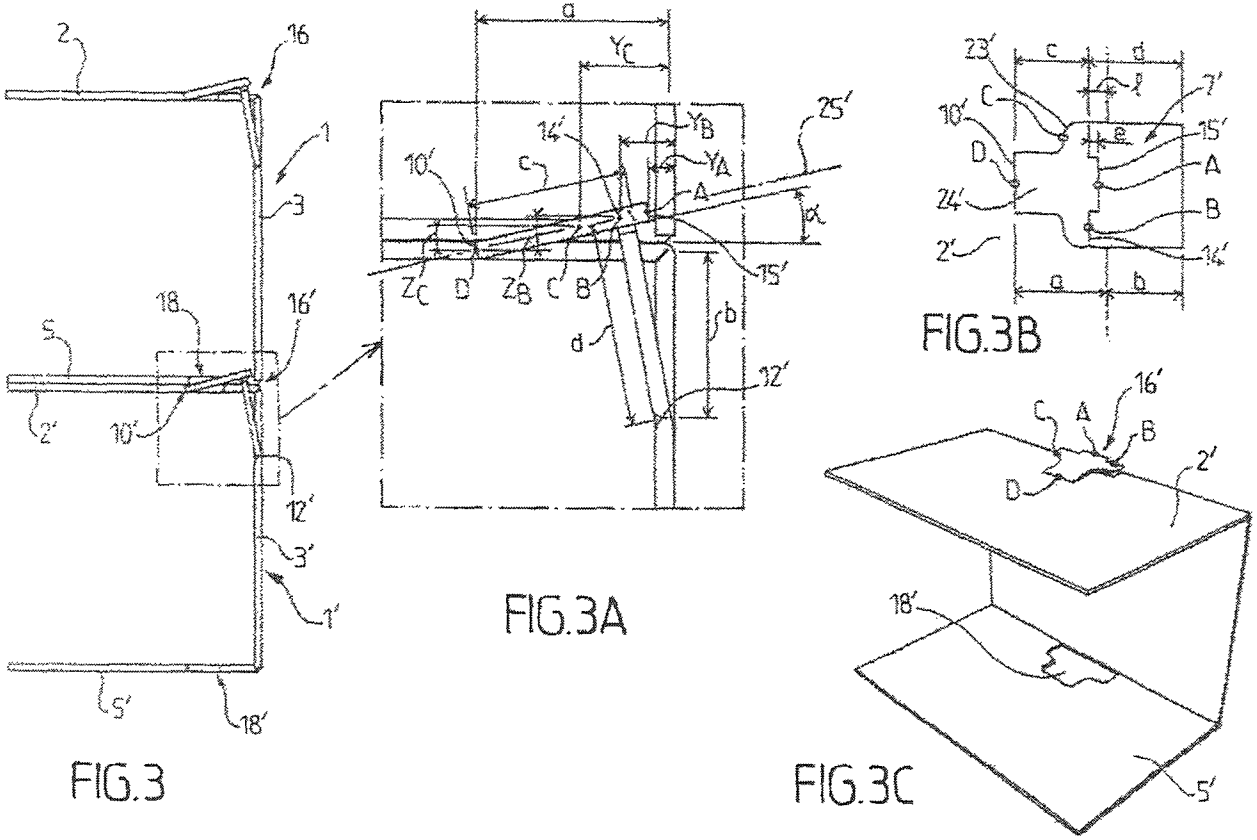
FIG. 3 is a cross-section along III-III in FIG. 2A showing the interlocking of two boxes obtained from the blank portion in FIG. 1A.
FIG. 3A is a magnified view of the interlocking zone in FIG. 3.
FIGS. 3B and 3C show the tab in FIG. 3A from above (FIG. 3B) and in perspective and when protruding (FIG. 3C) as already shown in FIG. 1B.

The blank portion 1 includes an upper wall 2 linked to a lateral wall 3 by a first fold line 4 and a lower wall 5 linked to the other side of the lateral wall 3 in relation to the first fold line 4 by a second fold line 6. The upper wall 2 is intended to form the top of the box while the lower wall 5 is intended to form the bottom of the box.

According to the embodiments of the invention more specifically described here, the blank portion 1 includes a centering tab 7 straddling the first fold line 4 cut along the lateral sides 8 of same crossing the first fold line 4.

The tab 7 is linked on one side 9 to the upper wall 2 by a first join line 10 and on the other side 11 to the adjacent lateral wall 3 by a second join line 12, said join lines 10 and 12 being parallel to the first fold line 4.

The tab 7 also includes a parallel intermediate fold line 13 that is offset by a distance l from the first fold line towards the center of the upper wall from the fold line 4.

In this embodiment, the join line 13 has two lateral portions 14 that are aligned with one another, at a distance l, and a central cutout portion 15 positioned at a distance l-e from the first fold line, e being the width of the projecting slot formed by this cutout portion in relation to the two aligned lateral portions of said intermediate join line.

The join lines enable the tab to be folded when shaping the upper wall in relation to the lateral wall when manufacturing the box.

Indeed, when folding the upper wall once the box has been filled with products, the tab 7 forms a portion 16 projecting from the upper face 17 of the upper wall 2 on account of the folding of one in relation to the other.

The bottom 5 has a perforated surface portion or recess that matches the shape of said projecting portion 16, that is aligned (dot-dash line 19) with this latter and arranged to fit (see FIGS. 2A and 2B) the projecting portion 16' of the above blank portion 1'.

More specifically, the recess 18 has a first end edge 19 that coincides or substantially coincides with the fold line 6, two lateral edges or lines cut in stages 20 having shoulders 21 that can cooperate, as described in more detail below, with the corresponding cut edges of the transverse lateral sides of the tab and a second end edge 22 parallel to the side 19 which cooperates substantially with the fold line 10 of the tab.

FIGS. 3, 3A, 3B and 3C show in greater detail the projecting portion 16' of the box below cooperating with the recess 18 of the box above to better illustrate operation of this latter.

The input data are as follows:

b=Height of fold of centering device

YC=Front horizontal locking of centering device

YB=Rear horizontal locking of centering device

YA=Rear horizontal locking of centering device with tenon

ZC=Height of front locking of centering device (≥1 thickness)

ZB=Height of rear locking of centering device (≥1.5 thicknesses)

Using these input data, it is possible to calculate the following data relating to the projecting portion:

a=Fold length of centering device c=Raised length of centering device d=Inclined height of centering device Points A, B, C, D, as shown in FIGS. 3, 3B, 3C, are aligned.

They are defined as follows:

Point A: central point of the cutout portion 15'. This point is a rear locking point of the projecting portion 16' or centering device in the recess (YA);

Point B: central point of the lateral aligned portion of the intermediate join line 14. This point is the fold and also serves as the rear lock of the centering device (YB);

Point C: central midpoint of the shoulder 23' of the tab portion 24' located on the side of the upper wall 2. This point is a front locking point of the centering device (YC);

Point D: central point of the first join line of the tab. This point is on the front fold of the centering device.

According to the embodiment of the invention, the four points A, B, C and D in the lateral plane in FIG. 3A are aligned on a straight line 25' according to the equation $y=a'x+b'$ in which $a'=(ZB-ZC)/(YB-YC)$ in which $b'=(ZC-((ZB-ZC)/YB-YC))*YC)$ $a=-b'/a'$ Alpha=arctan (b'/a)

c=(a−yB)/cos(alpha)

d=a+b−c (imposed by flat cut or a+b=c+d)

Figure 4B:
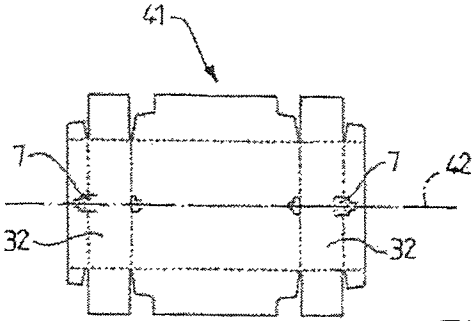
FIGS. 4A and 4B show respectively the blank used to obtain the dish in FIG. 4 and another embodiment of a blank for a dish according to the invention.
Figure 4:
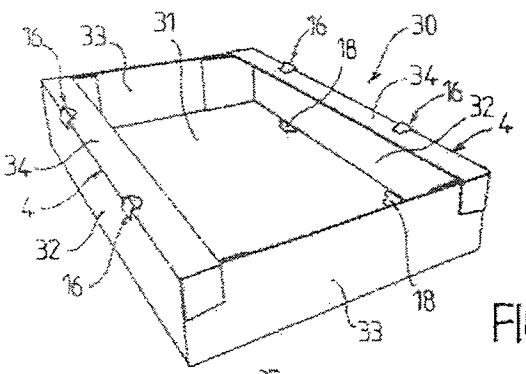
FIG. 4 is a perspective view of an embodiment of the box according to the invention in dish form.

FIG. 4 shows a dish 30 according to an embodiment of the invention.

The dish comprises a lower wall 31 and opposing paired lateral walls 32 and 33, in a known manner.

The lateral walls 32 are linked to two opposing ledges 34 by first fold lines 4 on which are formed projecting tabs 16, for example two projecting tabs 16 per fold line 4 arranged in pairs and facing one another for example level with the first quarter and the last quarter of the ledge, thereby forming the partial top of the dish 30. Opposing recesses or perforated surface portions 18 in line with the projecting portions 16 are formed as described with reference to the preceding figures.

Figure 4A:
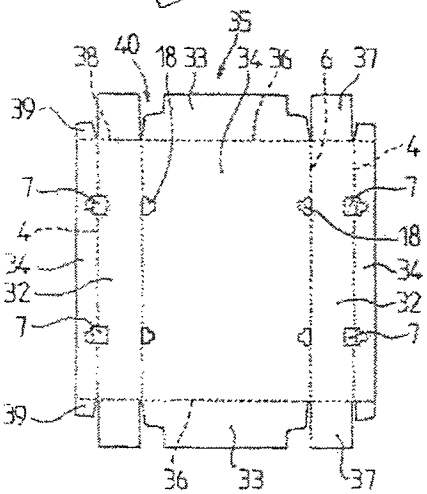

FIG. 4A is a top view of the blank 35 used to make the dish 30.

The lower wall 31 is in this case formed by a rectangle of corrugated cardboard 34 linked on the side of the side faces 32 by parallel fold lines 6 and on the other side to the lateral walls 33 by fold lines 36, rectangular attachment tabs 37 linked to the lateral walls 32 by fold lines 38 being provided to be bonded for example to the internal face of the lateral wall 33 during formation of the tray.

When folding the ledge 34 about the first fold line 4, which then enables formation of the projecting portion 16, two lugs 39 can be folded down on the external face of the tab 37, notably on account of a notch 40 formed in the lateral wall 33.

FIG. 4B shows another embodiment of a dish 41 according to the invention that in this case has only two tabs 7, i.e. one per lateral side 32 positioned centrally in relation to an axis of symmetry 42 of the tray.

Figure 5:
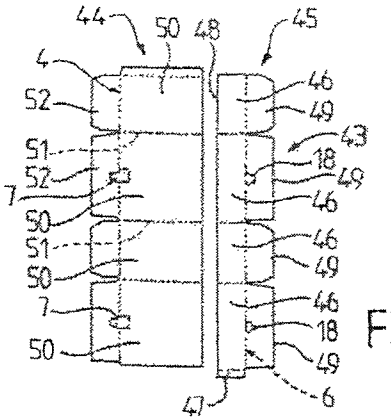
FIG. 5 is a top view of an embodiment of a set of blanks according to the invention.

FIG. 5 shows another embodiment, in this case a set 43 of two blanks 44 and 45, one of the blanks 45 being designed to form a lower tray of the box and the other blank 44 being designed to form the upper part or cover.

More specifically, the first blank 45 is formed by a succession of four rectangular walls 46 finished with an attachment tab 47 and having on one side a free edge 48 and on the other side a succession of flaps 49 linked to the walls 46 by the second fold line 6. The second blank 44 arranged to form the upper portion of the lateral walls is formed by a succession of four adjacent rectangular shutters 50 linked together by second parallel fold lines 51, the upper wall being formed by flaps 52 linked to the shutters 50 by first fold lines 4.

In the embodiment described, the set of blanks includes two tabs 7 straddling the fold lines 4 of two shutters used to form the upper part of the lateral walls 50 separated by an intermediate shutter, the recesses 18 being arranged in the flaps 49 to be positioned opposite and in line with the projecting portions, as described above during formation of the box.

Figure 6C:
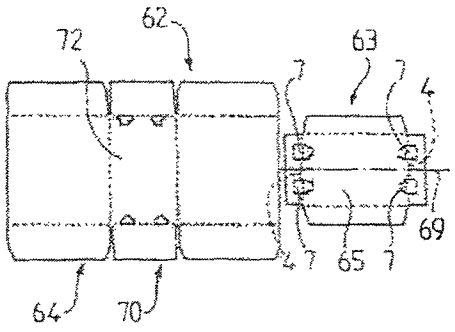
FIGS. 6A to 6C and 7A to 7C are top views showing other embodiments of sets of two blanks, one of which is used to form a tray according to the invention.
Figure 6B:
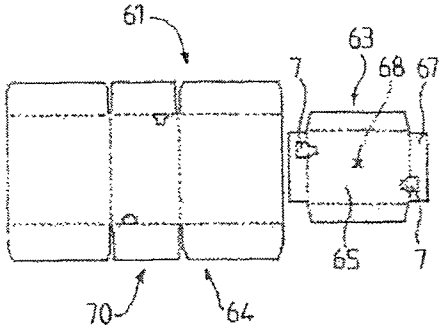
Figure 6A:
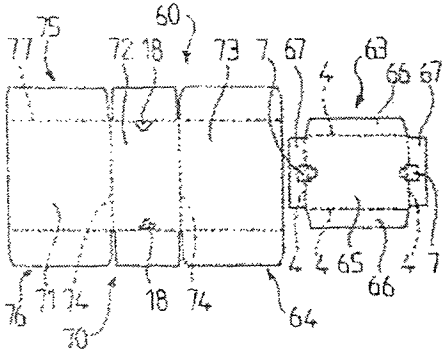

FIGS. 6A to 6C show other embodiments of sets of two blanks 60, 61, 62 according to the invention.

In this case, each set includes a first blank 63 and a second blank 64.

The first blank 63 designed to form a tray in a known manner includes a central shutter 65 provided on each of the sides of same with paired identical lateral flaps 66, 67 linked to the central shutter 65 by first fold lines 4, on two of which are formed straddling tabs 7 either centrally (FIG. 6A) or offset with symmetrical staggering in relation to the central point 68 of the central shutter 65 (FIG. 6B) or including for each of the fold lines 4 two opposing tabs 7 arranged symmetrically about a central axis of symmetry 69 of the tray. Each set 60, 61, 62 also includes the second blank 64 formed by a succession 70 of three adjacent rectangular shutters 71, 72, 73 linked together by third fold lines 74 and including on both sides a first set 75 and a second set 76 of flaps respectively linked to the adjacent shutter by fourth fold lines 77, fourth fold lines 77 of the adjacent central shutter 72 of this succession of three shutters forming second fold lines connected to the edge of the recesses 18 arranged to cooperate with the tabs 7.

In FIG. 6A, these recesses are aligned and facing, in FIG. 6B they are offset symmetrically in relation to a central point, and in FIG. 6C there are four recesses and they are symmetrical about a central axis of the shutter 72.

Figure 7C:
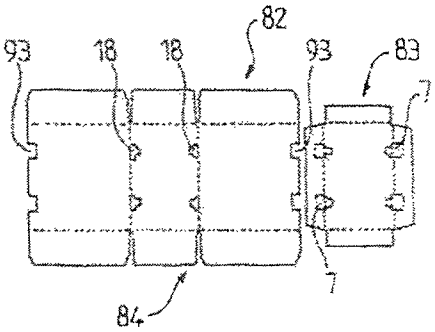
Figure 7B:
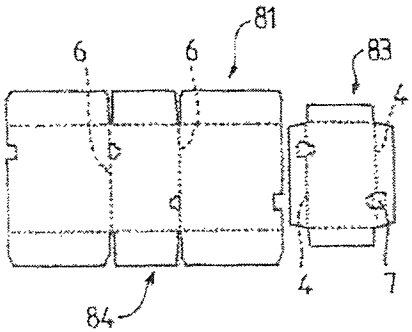
Figure 7A:
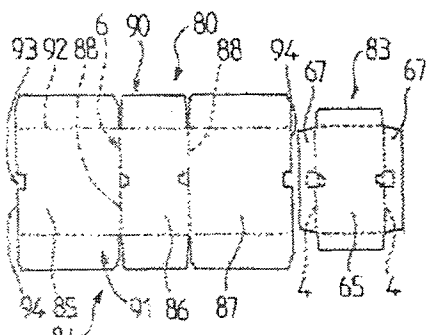

FIGS. 7A to 7C show three other embodiments of sets of blanks 80, 81, 82 including, similarly to the sets in FIGS. 6A to 6C, first blanks 83 used to form trays that are identical to the blank 63 in FIGS. 6A to 6C, and second blanks 84 that include a succession of three adjacent shutters 85, 86, 87 linked together by fifth fold lines 88, said fifth fold lines 88 then being combined with second fold lines 6 used to form the bottom of the packaging.

The succession of shutters also includes on either side a first set 90 and a second set 91 of flaps respectively linked to the adjacent shutters by sixth fold lines 92 to form two opposing lateral walls when forming the box.

Naturally, the upper or lower walls can be inverted, the second fold lines 6 then being inverted with the first fold lines 4.

In the embodiment in FIGS. 7A to 7C, notches 93 are required on the lateral end edges 94 of the second blank 84 to enable the projecting portions formed by the tabs 7 to pass through freely, as understood by the person skilled in the art.

FIG. 8, and FIGS. 8A to 8F respectively show a box and different embodiments of blanks according to the invention, i.e. essentially two types of blanks, i.e. a first type 95 corresponding to FIGS. 8A to 8C and a second type 96 corresponding to FIGS. 8D to 8F.

In this case, the blank according to the invention includes at least four adjacent shutters 97 linked together by seventh fold lines 98 to form the lateral walls, and they are provided on either side with a first set of flaps 99 and a second set of flaps 100, in FIGS. 8A to 8C, or with a first set of flaps 101 and a second set of flaps 102 in FIGS. 8D to 8F.

The first set of flaps 99 or 101 are linked to the lateral walls 97 by first fold lines 4, which then have tabs 7 on two of these first fold lines, as described above, the second set of flaps 100, 102 including second fold lines 6 joining with the adjacent lateral wall, about which the recess 18 is formed, as described above.

The recesses are offset or otherwise, depending on the position of the tab, centered in relation to the shutter (FIG. 8A), offset (FIG. 8B) or in pairs on each lateral face concerned (FIG. 8C) i.e. four tabs in total.

In FIGS. 8D and 8F, the recesses are arranged differently. Instead of being on a flap level with the join lines 6, the recesses are formed by two half-slots 103 that are symmetrical about a central axis 103' of a shutter 97 adjacent to the shutter that has the tab or tabs 7, thereby forming, when the box is folded, a slot with dimensions that match the dimensions of the tab, as claimed elsewhere.

In FIG. 8E, the tab is offset from the wall, and there is a single slot 104 on the opposite lateral edge of the flap in set 102, staggered in relation to the flap in set 101 on which the tab is found. Recesses or half-recesses 105 enabling passage of the tabs are also provided on the lateral edges of the flaps adjacent to the first fold lines 4.

FIG. 9 and FIGS. 9A to 9C show other embodiments of the box (FIG. 9) or "wrap" blanks 110.

In this case, the blanks are formed by a succession of shutters 111, 112, i.e. two shutters 111 intended to form the lateral walls and two shutters 112 intended respectably to form the lower wall and the upper wall of the packaging.

The upper wall of the packaging has two first fold lines 4, i.e. a first fold line 4 joining with the adjacent wall 111 and a first fold line 4 joining with a tab 113 enabling the wrap to be closed onto itself. In this case, a slot 114 is also provided to enable passage of the tab on the end edge of the end shutter 111, as described above.

Figure 9C:
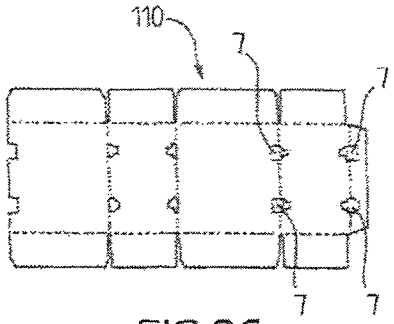
FIGS. 9B and 9C are top views of other embodiments of the blank in FIG. 9A according to the invention.

Again in this case, the tabs 7 can be centered (FIG. 9A), offset symmetrically in relation to a central point 115 of the corresponding lateral wall (FIG. 9B) and/or there may be four tabs i.e. two opposing tabs 7 per first fold line (FIG. 9C).

Figure 11:
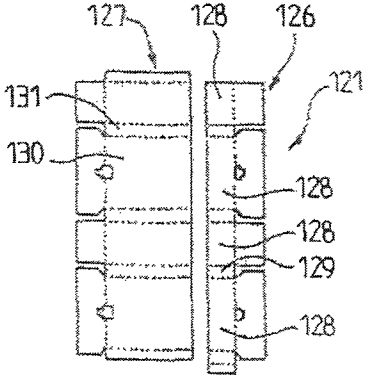
FIG. 11 shows an embodiment of a set of two blanks according to the invention with eight sides.
Figure 10:
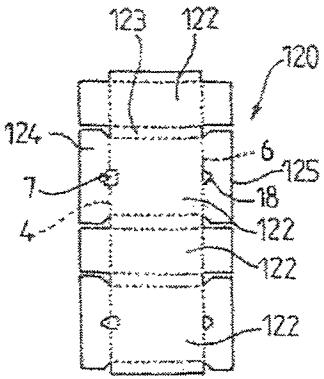
FIG. 10 is a top view of a blank for an eight-sided box according to one embodiment of the invention.
Figure 9:
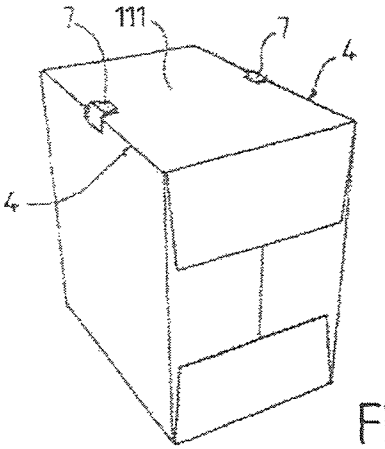
FIG. 9 is a perspective view of another embodiment of the box according to the invention.

FIGS. 10 and 11 show two other embodiments 120, 121 in two sets of blanks according to the invention.

In this case, there are four main walls 122 separated from one another by for intermediate walls 123 that have no flaps, the main walls having flaps on both sides 124 and 125, the flaps 124 being linked to the adjacent wall by first fold lines and having tabs 7 and the flaps 125 being linked by second fold lines 6 and having recesses 18.

More specifically, FIG. 11 has two blanks, i.e. a first blank 126 designed to form the tray-shaped bottom and a second blank 127 intended to form the top in a manner similar to the manner described above with reference to FIG. 10 except that in this case the first blank 126 has lower lateral main wall portions 128 separated by intermediate lateral wall portions 129 intended to form the cutoff points of the tray.

Conversely, the blank 127 has upper main walls 130 separated by intermediate walls 131.

To enable wrapping around each other, the joining fold lines between main walls and intermediate walls can, with reference to those in the second blank and those in the first blank, be slightly offset from the blank in relation to the other one, to facilitate wrapping.

FIGS. 12A to 12C show embodiments of tabs and corresponding recesses in different forms according to the invention.

FIG. 12A shows a tab 140 provided with a base portion 141 joining with the upper lateral wall 142 via the first join line 143 (small base), at least partially isosceles-trapezoid-shaped ending with an intermediate join line 144 (large base) with a second portion 145, joining with the adjacent lateral wall 146 by the second join line 147, said portion 145 being rectangular between the intermediate join line 44 and the join line 147 with the lateral wall.

The recess 148 is at least partially trapezoid-shaped and matches the shape of the base portion 141 of the tab, in accordance with the dimensions of the type of those described with reference to FIG. 3.

In this case, the recess has a lateral edge 149 that matches the second join line 150 for a first join line 151 which is straddled by the tab 152.

More specifically, the recess 148 therefore has an end forming a large base 149 that coincides or substantially coincides with the second join line 150. The recess 148 also has, in the lower wall 153, a rectangular recess part 154 and a trapezoid part 155 which ends in a small base 156 parallel to the large base 149 substantially equal in size to the join line 143 plus 1 or 2 mm providing the clearance required for a good fit of the tab once the projecting portion has been formed.

FIG. 12B shows a tab shaped slightly differently that corresponds to the one described with reference to FIGS. 1 to 3, but with no central portion cut out of the intermediate join line 158, the intermediate line therefore being a single part. The joining portion 159 with the upper wall 142 is in this case T-shaped, the base of same being in contact by the intermediate line 158 with the rectangular joining portion 160 located in the lateral wall 146.

In the embodiment in FIG. 12C, the recess portion 155 is identical or similar to the one described with reference to FIG. 12A. Conversely, the tab 152 in this case has a central cutout portion 161 releasing the fold line 162 on the sides in a manner similar to the manner described with reference for example to FIG. 3B.

FIGS. 13A, 13B, 13C show embodiments of blank portions respectively 163, 164, 165 corresponding to the embodiments in FIGS. 12A, 12B, 12C with a difference, namely in this case the recesses 166, 167, 168 are offset in relation to the second fold line by a distance d. This slight offsetting improves locking/engagement (see FIG. 3). The distance d is determined by the person skilled in the art in consideration of the specific configuration of the packaging sought.

The trapezium in FIG. 13C is inverted in relation to the trapezium in FIG. 12C. Consequently, as in the recesses described above, the recess is inverted symmetrically about an axis parallel to the first fold lines 151.

Figure 14:
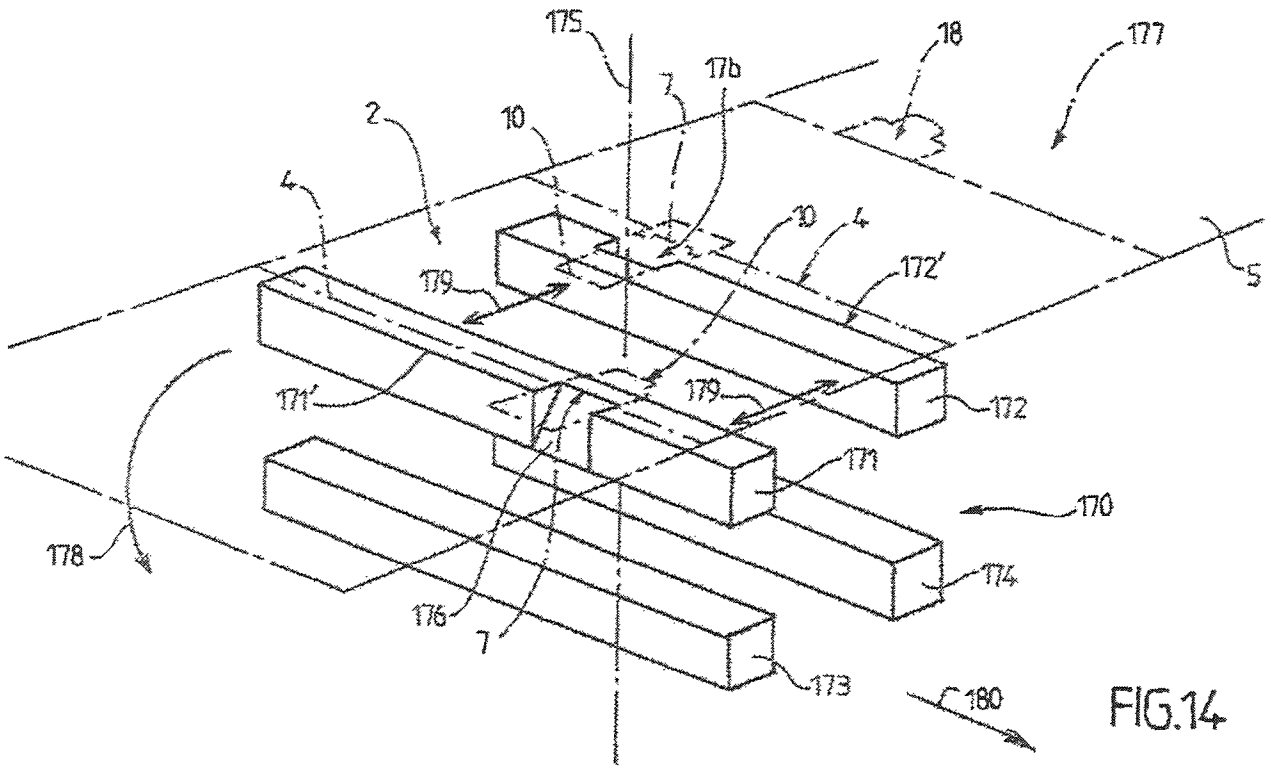
FIG. 14 is a schematic perspective view of a retractable-edge mandrill according to an embodiment of the invention for manufacturing boxes by wrapping around a mandrel.

FIG. 14 is a schematic view of a mandrel 170 having four parallelepiped corners 171, 172, 173, 174 arranged symmetrically in pairs about a central axis 175. The upper external edges 171' and 172' of these corners each have a slot 176 oriented towards the outside of the mandrel, in the form of a cutoff corner to enable folding of the projecting portion of the blank 177 (dot-dash line) having tabs 7 straddling the fold lines 4 as described above.

The section of the slot 176 is for example triangular, having a truncated parallelepiped shape, one of the sides of which coincides or substantially coincides with the join line of the tab with the lateral face.

Once the fold has been effected by wrapping (arrow 178), about the mandrel, the blank previously conveyed in a known manner for example by a known capture suction device (not shown) and the cutouts have been placed on the mandrel, the two upper corners 171 and 172 (and therefore the corresponding edges) of the mandrel are retracted (arrow 179) and the box can then be ejected (arrow 180) in a known manner, for example using an internal piston (not shown).

The description below, provided with particular reference to the embodiments in FIGS. 1A to 1B, 9B and FIG. 14, relates to a method for assembling and/or manufacturing a box according to the invention.

Figure 9B:
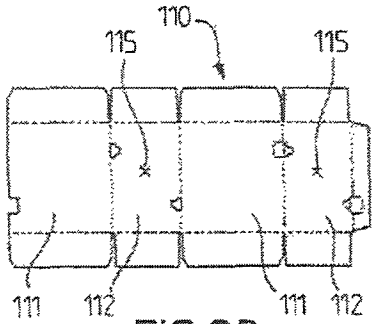
Figure 9A:
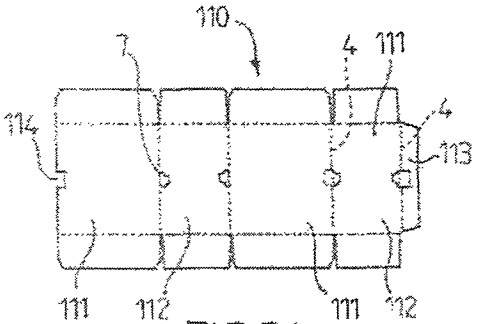
FIG. 9A is a top view of the blank used to obtain the box in FIG. 9.

Using a pile of blanks (not shown) of the type described with reference to FIG. 9B, which are received flat by the box manufacturer, said manufacturer conveys the blanks in question, for example automatically, using known suction gripping means (not shown) above or below a mandrel matching the shape of the packaging sought (see FIG. 14).

Furthermore, using in particular propulsive-force jacks and/or pivoting arms (not shown), the carton is folded 90° along the fold lines 4 and 6 of same about the edges of the mandrel, or at least in the case of blanks with cut edges for example, such that, in consideration of the offset of the intermediate join line and of the internal bearing linked to the edges of the mandrel on the blank during compression of this latter on these edges, bending automatically causes the projecting portion of the tab to come out without being hindered by the edge 171', 172' on account of the recesses 176, thereby creating the centering means sought.

The flaps forming the bottom of the box are also closed back following bonding onto the bottom of the mandrel before the carton has been ejected and after the corners 171 and 172 have been removed.

Naturally, in consideration of the foregoing, the present invention is not limited to the embodiments specifically described, but encompasses all variants and in particular variants in which the shape of the tabs is different from those described specifically herein, or variants in which the mandrel does not have retractable corners (edges), the cover being folded (once the rest of the box has been formed about the mandrel) by hand after the box has been filled, unlike with a wrap with reference to FIG. 14.

The invention claimed is:

1. A box made of corrugated cardboard sheet having a polygonal section comprising lateral walls, an upper wall forming the top of the box and connected to at least two of the lateral walls by first fold lines and a lower wall forming the bottom of the box, said box including at least one tab straddling at least one of said first fold lines and linked on one side to the upper wall by a first join line and on the other side to the adjacent lateral wall by a second join line, said join lines being parallel to said first fold line, said at least one tab having two lateral sides crossing said first fold line and being cut along said lateral sides, said at least one tab also having an intermediate parallel fold line offset towards the center of the box in relation to said first fold line, such that the at least one tab forms a portion projecting from the upper face of the upper wall on account of the folding of the lateral wall in relation to the upper wall, and the bottom of the box having at least one perforated surface portion arranged to cooperate with said projecting portion, to be aligned with said projecting portion, and to engage with the projecting portion of a box below, characterized in that the at least one tab is a centering tab and the perforated surface portion is a recess matching the shape of said at least one tab, the edges of the recess being arranged to cooperate in contact with lateral peripheral edges of said at least one tab, wherein the lateral peripheral edges of the at least one tab have a cavity defining shoulders and arranged to cooperate in contact with a matching cavity in the recess of a box above.

2. The box as claimed in claim 1, characterized in that the intermediate parallel fold line has two lateral portions aligned at a first distance from the first fold line on either side of a central cutout portion, wherein the central cutout portion is located at a distance less than the first distance from said first fold line.

3. The box as claimed in claim 2, characterized in that the second distance is between 1 mm and 3 mm.

4. The box as claimed in claim 2, characterized in that points A, B, C and D are defined as follows:

Point A: central point of the central cutout portion (15'),

Point B: central point of a lateral aligned portion of an intermediate join line (14), Point C: central midpoint of a shoulder (23') of a tab portion (24') located on a side of the upper wall (2), Point D: central point of the first fold line, the four points A, B, C, D are aligned with a straight line (25').

5. The box as claimed in claim 1, characterized in that the intermediate parallel fold line is at a distance of between 1 mm and 5 mm from said first fold line.

6. The box as claimed in claim 1, characterized in that the lower wall and the lateral walls are formed by a tray and the upper wall by two facing ledges linked to the adjacent lateral walls by first fold lines.

7. The box as claimed in claim 1, characterized in that the lower wall and a lower portion of the lateral walls are formed by a tray, and in that an upper portion of the lateral walls is formed by a succession of at least four adjacent shutters linked together by second fold lines, and in that the upper wall is formed by flaps linked to the adjacent shutters by said first fold lines.

8. The box as claimed in claim 1, characterized in that it includes a tray having a central shutter forming the upper or lower wall, and flaps, and in that the lateral walls and the lower or upper wall are formed by a succession of three adjacent shutters linked together by third fold lines and including on either side a first set and a second set of flaps respectively linked to the adjacent shutters by fourth fold lines or said first fold lines, to form two facing lateral walls.

9. The box as claimed in claim 1, characterized in that it includes a tray having a central shutter forming the upper or lower wall, and flaps, and in that the lateral walls and the lower or upper wall are formed by a succession of three adjacent shutters linked together by fifth fold lines or two of said first fold lines and including on either side a first set and a second set of flaps respectively linked to the adjacent shutters by sixth fold lines or two other first fold lines, to form two facing lateral walls.

10. The box as claimed in claim 1, characterized in that the lateral walls are formed by a succession of at least four adjacent shutters linked together by seventh fold lines and include on either side a first set of flaps and a second set of flaps respectively linked to the adjacent shutters by said first fold lines or eighth fold lines to form respectively the upper and lower walls.

11. The box as claimed in claim 9, characterized in that the recesses are formed by slots or by two slot portions on a corresponding lateral flap edge, and in that it includes a slot or two slot portions enabling the free passage of the tab on the adjacent flap edge located on the side of the tab.

12. The box as claimed in claim 1, characterized in that it comprises four main lateral walls separated by four intermediate walls with no flaps forming cutoff corners.

13. The box as claimed in claim 1, characterized in that it includes at least two centering tabs and two corresponding recesses.

14. The box as claimed in claim 1, characterized in that each tab and each corresponding recess is trapezoid-shaped.

15. The box as claimed in claim 1, characterized in that each tab and each corresponding recess is T-shaped.

16. The box as claimed in claim 1, characterized in that the recess has a parallel edge and is located at a distance d' from a connection line of a lateral wall with the lower wall, facing and parallel to the first fold line.

17. The box as claimed in claim 16, characterized in that d' is equal to 0.

18. The box as claimed in claim 16, characterized in that the projecting portion formed by the tab has an inclined height d and d' is equal to d.

19. A blank or set of blanks made of corrugated cardboard sheet intended to form a box having a polygonal section comprising lateral walls, an upper wall that is used to form the top of the box and that is connected to at least two of the lateral walls by first fold lines and a lower wall used to form the bottom of the box, said blank including at least one tab straddling at least one of said first fold lines, and linked on one side to the upper wall by a first join line and on the other side to the adjacent lateral wall by a second join line, said join lines being parallel to said first fold line, said at least one tab having two lateral sides crossing said first fold line and being cut along said lateral sides, said at least one tab also having an intermediate parallel fold line offset towards the center of the box in relation to said first fold line, such that the at least one tab forms a portion projecting from the upper face of the upper wall during folding of the lateral wall in relation to the upper wall, and the bottom of the box having at least one perforated surface portion arranged to cooperate with said projecting portion, and to be aligned with said projecting portion when the box is formed, and to engage with the projecting portion of a box below, characterized in that the at least one tab is a centering tab and the perforated surface portion is a recess matching the shape of said at least one tab, the edges of the recess of a box formed with said blank being arranged to cooperate in contact with the lateral peripheral edges of said tab of a box below formed using such a blank, wherein the lateral peripheral edges of the at least one tab have a cavity defining shoulders and arranged to cooperate in contact with a matching cavity in the recess of a box above.

20. The blank made of corrugated cardboard sheet as claimed in claim 19, characterized in that it includes a central shutter that is used to form a bottom of a tray and that is linked to four paired opposing flaps used to form lateral walls of said tray, two of said opposing flaps being linked on the other side of said central shutter to a second flap by said first fold lines to form two opposing ledges when the box is formed.

21. The set of blanks as claimed in claim 19, characterized in that it includes a first blank used to form a tray to form the lower wall and a lower portion of the lateral walls, and in that it includes a second flap used to form an upper portion of the lateral walls, said second blank comprising a succession of at least four adjacent shutters linked together by second fold lines, the upper wall being formable using flaps linked to the adjacent shutters by said first fold lines.

22. The set of blanks as claimed in claim 19, characterized in that it includes a first blank used to form a tray having a central shutter forming the upper or lower wall, and flaps, and a second blank used to form the lateral walls and the lower or upper wall, said second blank comprising a succession of three adjacent shutters linked together by third fold lines and including on either side a first set and a second set of flaps respectively linked to the adjacent shutters by fourth fold lines or said first fold lines, to form two facing lateral walls during formation of the box.

23. The set of blanks as claimed in claim 19, characterized in that it includes a first blank used to form a tray having a central shutter forming the upper or lower wall, and flaps, and a second blank used to form the lateral walls and the lower or upper wall, said second blank comprising a succession of three adjacent shutters linked together by fifth fold lines or two of said first fold lines and including on either side a first set and a second set of flaps respectively linked to the adjacent shutters by sixth fold lines or two other first fold lines, to form two facing lateral walls during formation of the box.

24. The blank as claimed in claim 19, characterized in that it includes a succession of at least four adjacent shutters linked together by seventh fold lines to form lateral walls provided on either side of a first set of flaps and of a second set of flaps linked respectively to the adjacent shutters by said first fold lines or eighth fold lines to form respectively the upper and lower walls during formation of the box.

25. The blank as claimed in claim 24, characterized in that the recesses are formed by slots or by two slot portions on a corresponding lateral flap edge, and in that it includes a slot or two slot portions enabling the free passage of the tab on the adjacent flap edge located on the side of the tab.

26. The blank or set of blanks as claimed in claim 19, characterized in that each blank is arranged to form four lateral walls or four main wall portions separated by four intermediate walls or wall portions with no flaps to form cutoff corners during formation of the box.

27. The blank or set of blanks as claimed in claim 19, characterized in that it includes at least two centering tabs and two corresponding recesses.

28. The blank or set of blanks as claimed in claim 19, characterized in that each tab and each corresponding recess is trapezoid-shaped.

29. The blank or set of blanks as claimed in claim 19, characterized in that each tab and each corresponding recess is T-shaped.

30. The blank or set of blanks as claimed in claim 19, characterized in that the recess has a parallel edge and is located at a distance d' from a connection line of a lateral wall with the lower wall, facing and parallel to the first fold line.

31. A method comprising:

forming, from a blank or set of blanks made of corrugated cardboard sheet, a box having a polygonal section comprising lateral walls, an upper wall forming the top of the box and connected to at least two of the lateral walls by first fold lines and a lower wall forming the bottom of the box, characterized in that given that said box includes at least one tab straddling at least one of said first fold lines and linked on one side to the upper wall by a first join line and on the other side to the adjacent lateral wall by a second join line, said join lines being parallel to said first fold line, said at least one tab having two lateral sides crossing said first fold line and being cut along said lateral sides, said at least one tab also having an intermediate parallel fold line that is offset towards the center of the box in relation to said first fold line, such that the at least one tab forms a portion projecting from the upper face of the upper wall during folding of the lateral wall in relation to the upper wall and the bottom of the box having at least one perforated surface portion arranged to cooperate with said projecting portion, and to engage with the projecting portion of a box below, characterized in that the at least one tab is a centering tab and the perforated surface portion is a recess matching the shape of said at least one tab, the edges of the recess of the box being arranged to cooperate in contact with the lateral peripheral edges of said tab of the box below, wherein the lateral peripheral edges of the at least one tab have a cavity defining shoulders and arranged to cooperate in contact with a matching cavity in the recess of a box above.

32. The method as claimed in claim 31, characterized in that:

the box is formed about a mandrel, wherein the edges of the mandrel have a receiving slot, and the box is formed by folding the lateral wall in relation to the upper wall about an edge of said mandrel, such that the tab forms a portion projecting from the upper face of the upper wall on account of said folding and engages with the inside of said slot, and in that the mandrel is retractable or includes zones that are retractable into the volume of same, the slotted edges are removed before ejection of the box.

33. The method as claimed in claim 31, characterized in that at least two projecting portions on two opposing fold lines of the upper wall are formed.

* * * * *